United States Patent [19]

Kral

[11] 4,063,534

[45] Dec. 20, 1977

[54] COAL-FIRED STEAM GENERATOR WITH HEATING SURFACES ABOVE THE FIRING OR COMBUSTION CHAMBER

[75] Inventor: Rudolf Kral, Bruninghof near Erlangen, Germany

[73] Assignee: Kraftwerk Union Aktiengesellschaft, Mulheim (Ruhr), Germany

[21] Appl. No.: 689,569

[22] Filed: May 24, 1976

[30] Foreign Application Priority Data

May 22, 1975 Germany ..... 2522724

[51] Int. Cl.[2] ..... F22B 37/24

[52] U.S. Cl. ..... 122/510; 122/476

[58] Field of Search ..... 122/476, 478, 510

[56] References Cited

U.S. PATENT DOCUMENTS

| | | | |
|---|---|---|---|
| 3,060,909 | 10/1962 | Ott | 122/510 |
| 3,307,523 | 3/1967 | Palchik et al. | 122/510 |

*Primary Examiner*—Kenneth W. Sprague

*Attorney, Agent, or Firm*—Herbert L. Lerner

[57] ABSTRACT

A coal-fired steam generator has tubes forming heating surfaces that are suspended above a combustion chamber from support tubes that extend in a given direction and are mutually spaced apart, transversely to the axes of the tubes forming the heating surfaces, a distance that is less than the mutual spacing of the support tubes in the direction of the axes of the tubes forming the heating surfaces. The support tubes located below the lowermost of the tubes forming the heating surfaces suspended therefrom are formed with an initial bend in a plane wherein the support tubes are mutually spaced apart by the lesser distance, and are provided with further bends forming auxiliary heating surfaces extending substantially perpendicularly to the given direction in which the support tubes extend.

3 Claims, 3 Drawing Figures

COAL-FIRED STEAM GENERATOR WITH HEATING SURFACES ABOVE THE FIRING OR COMBUSTION CHAMBER

The invention relates to coal-fired steam generators having heating surfaces located above a respective firing or combustion chamber.

Coal-fired steam generators can have a single or double entry construction. In boilers wherein contact heating surfaces for economizers, superheaters or intermediate superheaters are disposed above the firing or combustion chamber, these contact heating surfaces are able to be suspended from water or steam-cooled support tubes.

For the layout or construction of such a steam generator to be satisfactory, the free firing or combustion chamber must be at least so high that the combustion gases will have been cooled to such an extent at the upper end of the chamber that the ash will not adhere to the heating surfaces. Otherwise ash bridges are formed between the heating surfaces in this firing or combustion chamber zone, which reduce the effective surface for heat transfer and block free passage of the combustion gases.

It is accordingly an object of the invention to provide a coal-fired steam generator of the foregoing type wherein a firing or combustion chamber is provided which minimizes the required structural height of the steam generator without diminishing the total effective surface of the heating surfaces.

With the foregoing and other objects in view, there is provided in accordance with the invention, in a coal-fired steam generator wherein tubes forming heating surfaces are suspended above a firing chamber from support tubes that extend in a given direction and are mutually spaced apart, transversely to the axes of the tubes forming the heating surfaces, a distance that is less than the mutual spacing of the support tubes in the direction of the axes of the tubes forming the heating surfaces, the improvement comprising, the support tubes located below the lowermost of the tubes forming the heating surfaces suspended therefrom are formed with an initial bend in a plane wherein the support tubes are mutually spaced apart by the lesser distance, and are provid ed with further bends forming auxiliary heating surfaces extending substantially perpendicularly to the given direction in which the support tubes extend.

In accordance with another feature of the invention, the mutual spacing of the auxiliary heating surfaces formed from the support tubes is at least so great that no ash bridges are formed therebetween by adhering ash.

In accordance with a further feature of the invention, the mutual spacing between the auxiliary heating surfaces formed from the support tubes is equal to the mutual spacing between the support tubes in direction of the axes of the tubes forming the heating surfaces and suspended from the support tubes. In accordance with an additional feature of the invention, the support tubes are formed with a plurality of bends in the plane wherein the mutual spacing between the support tubes is the lesser distance.

Other features which are considered as characteristic for the invention are set forth in the appended claims. Although the invention is illustrated and described herein as embodied in a coal-fired steam generator with heating surfaces above the firing or combustion chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
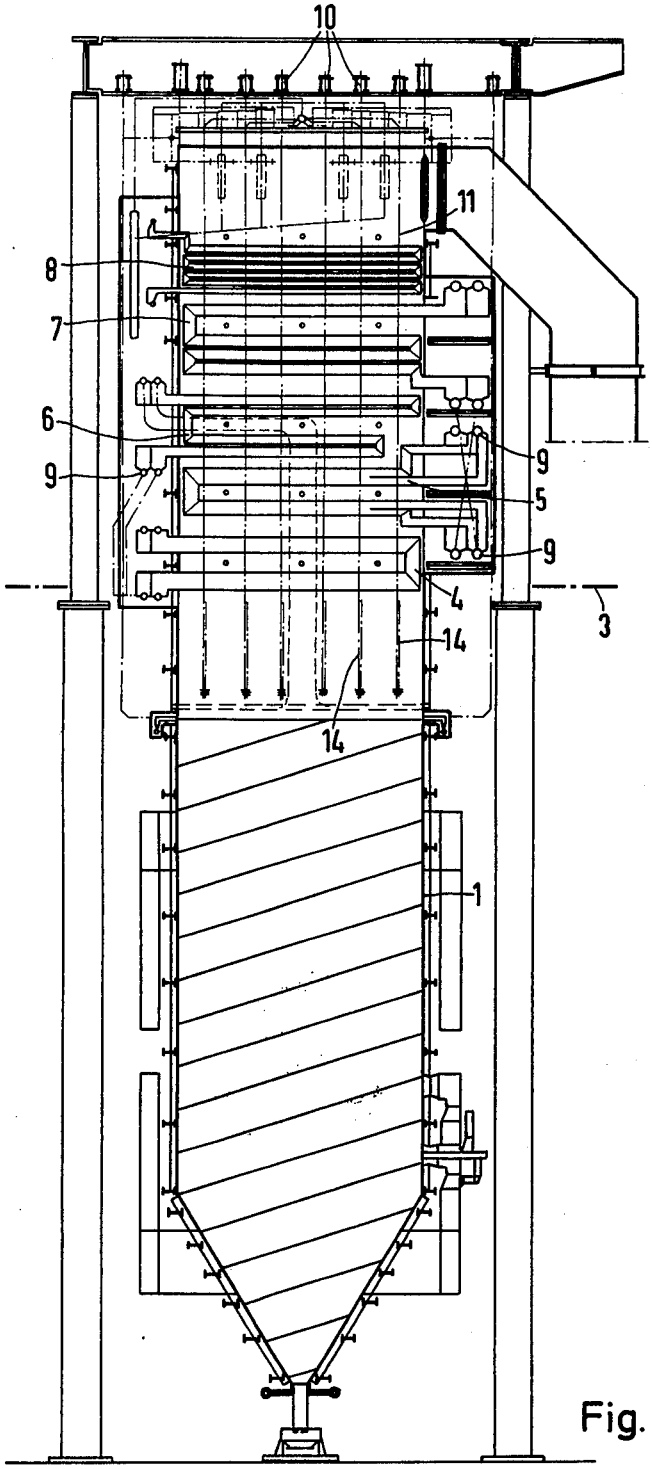
FIG. 1 is a diagrammatic front elevational view of the steam generator with coal-firing equipment and heating surface members located above the combustion or firing chamber.
Figure 2:
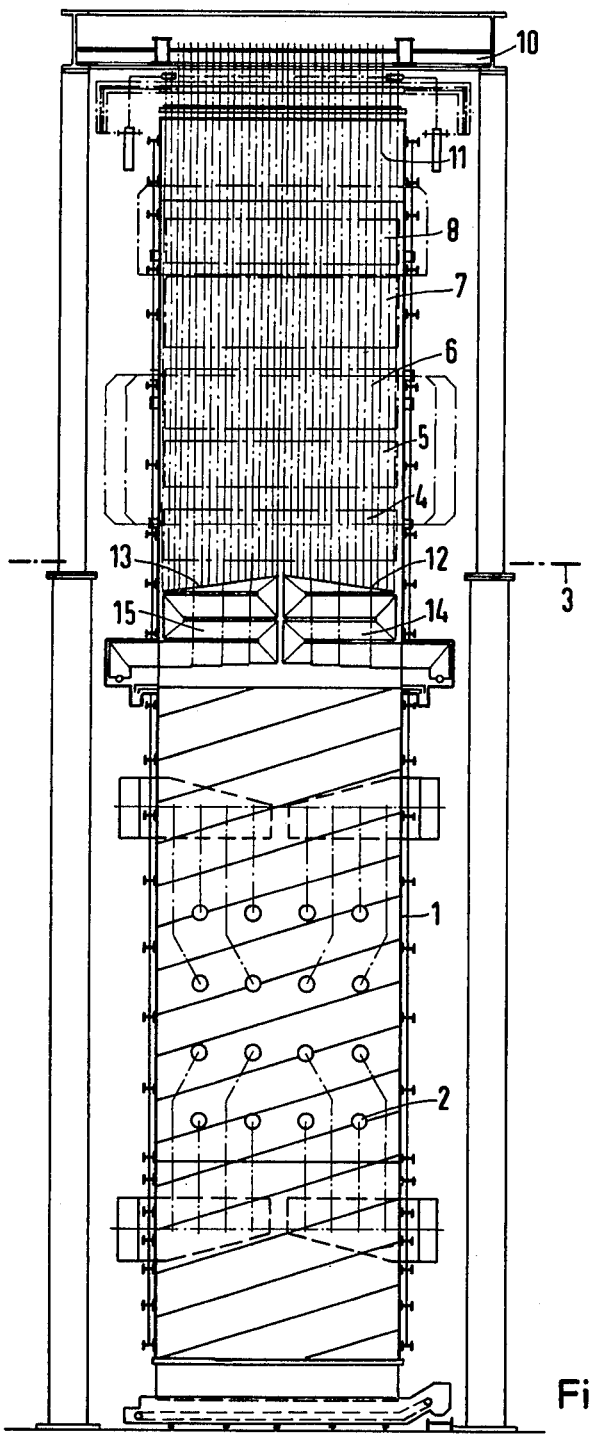
FIG. 2 is a diagrammatic side elevational view of FIG. 1.

Referring now to the drawing, and first, particularly, to FIGS. 1 and 2 thereof, there is shown an embodiment of the steam generator of the invention having a combustion or firing chamber 1, the sides of which are formed of radiant heating surface members consisting of would tubes set in ascending or rising direction. Burners 2 which burn powdered coal mixed with air, are provided at various levels of the combustion chamber 1. The ascending combustion gases are cooled to such an extent in the combustion chamber 1 up to the height indicated by the dot-dash line 3 that the temperature thereof falls below the ash fusion point i.e. the temperature below which the ash no longer coheres. Heating surface members 4 to 8 are disposed above the dot-dash line 3 are formed of tube bundles, the inlets and outlets of which at headers or manifolds 9 are shown in FIG. 1. The heating surface 8, for example, represents an economizer, the heating surfaces 5 and 7 an intermediate superheater, and the heating surfaces 4 and 6 a superheater. All of the heating surfaces 4 to 8 are suspended from support tubes 11 which are, in turn, fastened to supports 10 and, in longitudinal direction of the tubes of the heating surface 4 to 8 i.e. in the cross-sectional view of FIG. 1, the support tubes 11 exhibit a greater mutual spacing than in direction extending transversely to the longitudinal axes of the tubes of the heating surfaces 4 to 8, the latter closer spacing of the support tubes 11 from one another being readily apparent in the cross-sectional view of FIG. 2.

The support tubes 11 are bent substantially perpendicularly below the lowermost heating surface members 4, in the plane in which the respective adjacent support tubes 11 have the smaller mutual spacing i.e. in the view of FIG. 2. The bending points are shown at 12 and 13 in FIG. 2. The thus bent support tubes 11 are bent downwardly therefrom within the same plane and accordingly form meandering or more-or-less sinusoidal auxiliary heating surfaces 14 and 15. As is apparent from FIG. 1, these auxiliary heating surfaces 14 and 15, only the surfaces 14 being shown in FIG. 1, are spaced relatively distant from one another, so that it is not possible for ash bridges to form between adjacent heating surfaces unless the ash is cohesive.

Figure 3:
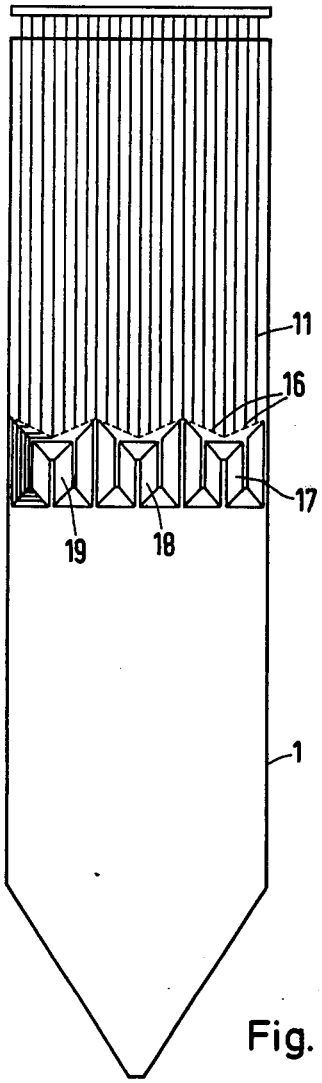
FIG. 3 is a fragmentary diagrammatic side elevational view of another embodiment of the invention.

FIG. 3 shows an embodiment of the invention in principle similar to the embodiment as shown in the cross-sectional view of FIG. 2, however, it differs from FIG. 2 with respect to the guidance of the lengthened or extended support tubes 11. Thus, in FIG. 3, not all of the support tubes 11 are combined into one heating surface, but rather, only a respective part of the support tubes 11 is initially bent in direction of the plane in which the support tubes 11 have the smaller mutual spacing, as shown by the bending points 16 indicated as broken lines 16. These tube bundles are bent in V-shaped form alternatingly upwardly and downwardly, and accordingly from three auxiliary heating surfaces 17, 18 and 19 disposed in one plane. Also, the planes of mutually parallel auxiliary heating surfaces are spaced so distant from one another that no ash bridges can form therebetween.

With the illustrated embodiments of the invention, it is possible to provide heating surfaces within the combustion chamber 11 at locations where the ash has not yet been cooled below the ash fusion point. The advantage thereof is that, for equal boiler capacity, the structural height of the boiler can be reduced and a considerable part of the construction costs can consequently be saved.

The invention is not limited to steam generators wherein the tubes are bent only in the plane wherein the support tubes have a small mutual spacing. They can also be bent in other ways just as all heating surfaces are bent. It is a prerequisite or requirement only, that the support tubes, due to the initial bend therof in the plane wherein the support tubes are spaced a relatively short distance from one another and due to further bends are so formed that auxiliary heating surfaces are formed, that have adequate mutual spacing for preventing the onset or development of ash bridges.

There are claimed:

1. In a coal-fired steam generator wherein tubes forming heating surfaces are suspended above a firing chamber from support tubes that extend in a given direction and are mutually spaced apart, transversely to the longitudinal axis of the tubes forming the heating surfaces, a distance that is less than the mutual spacing of the support tubes in the direction of the longitudinal axis of the tubes forming the heating surfaces, the improvement therein comprising, an initial bend in a plane wherein the support tubes are mutually spaced apart by said lesser distance being formed in the support tubes located below the lowermost of the tubes forming the heating surfaces suspended therefrom, and further bends provided in the support tubes and forming auxiliary heating surfaces extending substantially perpendicular to the given direction in which said support tubes extend, the mutual spacing between said auxiliary heating surfaces formed from the support tubes being equal to the mutual spacing between the support tubes in direction of the longitudinal axis of the tubes forming the heating surfaces and suspended from the support tubes.

2. Steam generator according to claim 1 wherein the mutual spacing of said auxiliary heating surfaces formed from the support tubes is at least so great that no ash budges are formed therebetween by adhering ash.

3. Steam generator according to claim 1 wherein said support tubes are formed with a plurality of bends in said plane wherein the mutual spacing between the support tubes is said lesser distance.

* * * * *